US010964207B2

(12) United States Patent
Mobasser

(10) Patent No.: US 10,964,207 B2
(45) Date of Patent: Mar. 30, 2021

(54) SYSTEMS AND METHODS FOR MANAGING TRAFFIC FLOW USING CONNECTED VEHICLE DATA

(71) Applicant: Fortran Traffic Systems Limited, Toronto (CA)

(72) Inventor: Farid Mobasser, Toronto (CA)

(73) Assignee: Fortran Traffic Systems Limited, Toronto (CA)

( * ) Notice: Subject to any disclaimer, the term of this patent is extended or adjusted under 35 U.S.C. 154(b) by 0 days.

(21) Appl. No.: 16/686,335

(22) Filed: Nov. 18, 2019

(65) Prior Publication Data

US 2020/0160701 A1 May 21, 2020

Related U.S. Application Data

(60) Provisional application No. 62/769,282, filed on Nov. 19, 2018.

(51) Int. Cl.
*G08G 1/083* (2006.01)
*G08G 1/01* (2006.01)

(52) U.S. Cl.
CPC ..... *G08G 1/083* (2013.01); *G08G 1/0112* (2013.01); *G08G 1/0125* (2013.01); *G08G 1/0145* (2013.01)

(58) Field of Classification Search
CPC G08G 1/07; G08G 1/08; G08G 1/081; G08G 1/0145; G08G 1/082; G08G 1/083; G08G 1/0112; G08G 1/0125; G08G 1/095
(Continued)

(56) References Cited

U.S. PATENT DOCUMENTS 6,633,238 B2 10/2003 Lemelson et al.
7,388,501 B2 6/2008 Tang et al.
(Continued)

FOREIGN PATENT DOCUMENTS

CA 2774127 A1 3/2011
CA 2932191 A1 6/2015
(Continued)

OTHER PUBLICATIONS

International Search Report and Written Opinion of corresponding International Patent Application No. PCT/CA2019/051640, 8 pgs.

*Primary Examiner* — Hung T Nguyen
(74) *Attorney, Agent, or Firm* — Bereskin & Parr LLP/ S.E.N.C.R.L., S.R.L.

(57) ABSTRACT

Various embodiments are described herein for systems and methods of traffic management in a road network including pathways and at least one intersection. In at least one embodiment, the method comprises receiving data signals from corresponding one or more connected vehicles and generating an intersection model for each approach of each intersection at a first time, where the intersection model comprises estimated arrival times for incoming vehicles at each approach. The method further comprises generating at the first time, for each intersection, candidate traffic timing data signals based at least on the intersection model corresponding to all approaches at the intersection, and generating, at the first time, for each intersection, an optimized traffic timing data signal, which is configured to control the operation of one or more traffic signals at the intersection, and is generated based on the candidate traffic timing data signals and a predetermined optimization variable.

29 Claims, 10 Drawing Sheets

(58) Field of Classification Search
USPC ..... 340/905, 906, 910, 917, 924
See application file for complete search history.

(56) References Cited

U.S. PATENT DOCUMENTS

| | | | | |
|---|---|---|---|---|
| 7,466,227 | B2 | 12/2008 | Chen et al. | |
| 8,150,609 | B2 * | 4/2012 | Yun | G08G 1/091 701/118 |
| 8,280,791 | B2 | 10/2012 | Davis, III et al. | |
| 8,928,493 | B2 | 1/2015 | Mantalvanos | |
| 9,208,684 | B2 | 12/2015 | Lee et al. | |
| 9,483,939 | B2 | 11/2016 | Modica et al. | |
| 9,599,488 | B2 | 3/2017 | Wynter et al. | |
| 9,633,560 | B1 * | 4/2017 | Gao | G08G 1/0145 |
| 2003/0063015 | A1 | 4/2003 | Ebner et al. | |
| 2005/0134478 | A1 | 6/2005 | Mese et al. | |
| 2010/0070128 | A1 | 3/2010 | Johnson | |
| 2010/0085213 | A1 | 4/2010 | Turnock et al. | |
| 2013/0006725 | A1 | 1/2013 | Simanek et al. | |
| 2014/0310041 | A1 * | 10/2014 | Crocker | G06Q 10/063114 705/7.15 |
| 2015/0015421 | A1 * | 1/2015 | Krijger | G08G 1/096716 340/932 |
| 2016/0090055 | A1 | 3/2016 | Breed | |
| 2016/0343175 | A1 | 11/2016 | Nyalamadugu et al. | |
| 2017/0053529 | A1 | 2/2017 | Yokoyama et al. | |
| 2018/0061232 | A1 * | 3/2018 | Madigan | B60W 50/14 |
| 2018/0089996 | A1 * | 3/2018 | Li | H04L 67/10 |
| 2018/0096595 | A1 * | 4/2018 | Janzen | G08G 1/0175 |
| 2019/0189001 | A1 * | 6/2019 | Smothers | G08G 1/09675 |

FOREIGN PATENT DOCUMENTS

| | | | |
|---|---|---|---|
| CN | 104751650 | A | 7/2015 |
| CN | 105761515 | A | 7/2016 |
| CN | 110619752 | A | 12/2019 |
| GB | 1375813 | A | 11/1974 |
| WO | 2015099645 | A1 | 7/2015 |
| WO | 2018097609 | A1 | 5/2018 |

* cited by examiner

SYSTEMS AND METHODS FOR MANAGING TRAFFIC FLOW USING CONNECTED VEHICLE DATA

This application claims the benefit of Provisional Application Ser. No. 62/769,282, filed Nov. 19, 2018, which is hereby incorporated herein by reference.

FIELD

The described embodiments relate to systems and methods for managing traffic flow in a road network, and in particular, to systems and methods for managing traffic flow in the road network using connected vehicle data.

BACKGROUND

Conventional systems and methods for managing traffic flow typically divert traffic away from congested pathways (e.g. roads, highways) and propose alternative routes to the vehicles to reach their destination. Typically, conventional systems and methods prioritize the preferences of each vehicle individually, without considering the overall impact on the traffic, involving many vehicles, over a larger geographical area. Consequently, the conventional systems and methods are typically inefficient and ineffective. There is a need for systems and methods to manage traffic flow in an efficient and accurate manner.

SUMMARY

In one aspect of the disclosure, in at least one embodiment described herein, there is provided a method of traffic management in a road network including a plurality of pathways and at least one intersection corresponding to two or more of the plurality of pathways. The method is implemented by a traffic management system including a processor and a memory coupled to the processor and configured to store instructions executable by the processor. The method comprises receiving, at the processor, a plurality of data signals from a corresponding one or more connected vehicles; generating, at the processor, an intersection model for each approach of each intersection in the road network, the intersection model being generated at a first time based on the plurality of data signals, the intersection model comprising estimated arrival times for incoming vehicles at each approach at the first time; generating, at the processor and at the first time, for each intersection, a plurality of candidate traffic timing data signals for controlling an operation of one or more traffic signals at the intersection, the plurality of candidate traffic timing data signals being generated based at least on the intersection model corresponding to all approaches at the intersection; and generating, at the processor and at the first time, for each intersection, an optimized traffic timing data signal, the optimized traffic timing data signal being configured to control the operation of one or more traffic signals at the intersection, and being generated based on the plurality of candidate traffic timing data signals and at least one predetermined optimization variable.

In some embodiments, the at least one predetermined optimization variable minimizes an overall arrival time corresponding to that intersection.

In some other embodiments, the at least one predetermined optimization variable minimizes an overall travel time corresponding to the road network.

In some embodiments, the method comprises generating, at the processor and at the first time, a routing signal for a connected vehicle, the routing signal being configured to route the connected vehicle between a current location and a destination location associated with the connected vehicle, the routing signal being based at least on a predetermined routing variable, the plurality of data signals and the optimized traffic timing data signals.

In some embodiments, the predetermined routing variable is configured to minimize an overall travel time between the current location and the destination location of the connected vehicle.

In some other embodiments, the predetermined routing variable is configured to minimize an overall travel time associated with the one or more connected vehicles in the road network.

In some embodiments, at least some data signals comprise an originating location and a destination location of the corresponding connected vehicle.

In some embodiments, the method further comprises receiving, at the processor, one or more infrastructure data signals comprising traffic information detected by one or more sensors along the road network.

In some embodiments, at least one data signal comprises a current location of an unconnected vehicle.

In some embodiments, the method further comprises generating, at the processor, for each intersection, a plurality of intermediate traffic timing data signals from the plurality of candidate traffic timing data signals based on one or more traffic signal control parameters.

In some embodiments, at least one traffic signal control parameter corresponds to a regulation standard.

In some embodiments, the first time is a predetermined range of time.

In some other embodiments, the first time in a predetermined instance of time.

In some embodiments, the method further comprises receiving, at the processor, a feedback signal from a driver of the connected vehicle.

In another aspect of the disclosure, in at least one embodiment described herein, there is provided a traffic management system for managing traffic in a road network including a plurality of pathways and at least one intersection corresponding to two or more of the plurality of pathways. The traffic management system comprises a processor unit; and a memory unit coupled to the processor unit and configured to store instructions executable by the processor unit, the processor unit being configured to: receive a plurality of data signals from a corresponding one or more connected vehicles; generate an intersection model for each approach of each intersection in the road network, the intersection model being generated at a first time based on the plurality of data signals, the intersection model comprising estimated arrival times for incoming vehicles at each approach at the first time; generate at the first time, for each intersection, a plurality of candidate traffic timing data signals for controlling an operation of one or more traffic signals at the intersection, the plurality of candidate traffic timing data signals being generated based at least on the intersection model corresponding to all approaches at the intersection; and generate at the first time, for each intersection, an optimized traffic timing data signal, the optimized traffic timing data signal being configured to control the operation of one or more traffic signals at the intersection, and being generated based on the plurality of candidate traffic timing data signals and at least one predetermined optimization variable.

In some embodiments, the at least one predetermined optimization variable minimizes an overall arrival time corresponding to that intersection.

In some other embodiments, the at least one predetermined optimization variable minimizes an overall travel time corresponding to the road network.

In various embodiments, the processor unit is further configured to generate, at the first time, a routing signal for the connected vehicle, the routing signal being configured to route the connected vehicle between a current location and a destination location associated with the connected vehicle, the routing signal being based at least on a predetermined routing variable, the plurality of data signals and the optimized traffic timing data signals.

In some embodiments, the predetermined routing variable is configured to minimize an overall travel time between the current location and the destination location of the connected vehicle.

In some other embodiments, the predetermined routing variable is configured to minimize an overall travel time associated with the one or more connected vehicles in the road network.

In some embodiments, at least some data signals comprise an originating location and a destination location of the corresponding connected vehicle.

In some other embodiments, the processor unit is further configured to receive one or more infrastructure data signals comprising traffic information detected by one or more sensors along the road network.

In some embodiments, at least one data signal comprises a current location of an unconnected vehicle.

In some other embodiments, the processor unit is further configured to generate, for each intersection, a plurality of intermediate traffic timing data signals from the plurality of candidate traffic timing data signals based on one or more traffic signal control parameters.

In some embodiments, at least one traffic signal control parameter corresponds to a regulation standard.

In some embodiments, the first time is a predetermined range of time.

In some other embodiments, the first time in a predetermined instance of time.

In various embodiments, the processor unit is configured to perform other methods as described above.

In a further aspect of the disclosure, in at least one embodiment described herein, there is provided a computer-readable medium storing computer-executable instructions, the instructions for causing a processor to perform a method of managing traffic over a road network, where the method comprises receiving, at the processor, a plurality of data signals from a corresponding one or more connected vehicles; generating, at the processor, an intersection model for each approach of each intersection in the road network, the intersection model being generated at a first time based on the plurality of data signals, the intersection model comprising estimated arrival times for incoming vehicles at each approach at the first time; generating, at the processor and at the first time, for each intersection, a plurality of candidate traffic timing data signals for controlling an operation of one or more traffic signals at the intersection, the plurality of candidate traffic timing data signals being generated based at least on the intersection model corresponding to all approaches at the intersection; and generating, at the processor and at the first time, for each intersection, an optimized traffic timing data signal, the optimized traffic timing data signal being configured to control the operation of one or more traffic signals at the intersection, and being generated based on the plurality of candidate traffic timing data signals and at least one predetermined optimization variable.

In various embodiments, the processor is configured to perform other methods as described above.

Other features and advantages of the present application will become apparent from the following detailed description taken together with the accompanying drawings. It should be understood, however, that the detailed description and the specific examples, while indicating preferred embodiments of the application, are given by way of illustration only, since various changes and modifications within the spirit and scope of the application will become apparent to those skilled in the art from the detailed description.

BRIEF DESCRIPTION OF THE DRAWINGS

For a better understanding of the various embodiments described herein, and to show more clearly how these various embodiments may be carried into effect, reference will be made, by way of example, to the accompanying drawings which show at least one example embodiment and the figures will now be briefly described.

Figure 1:
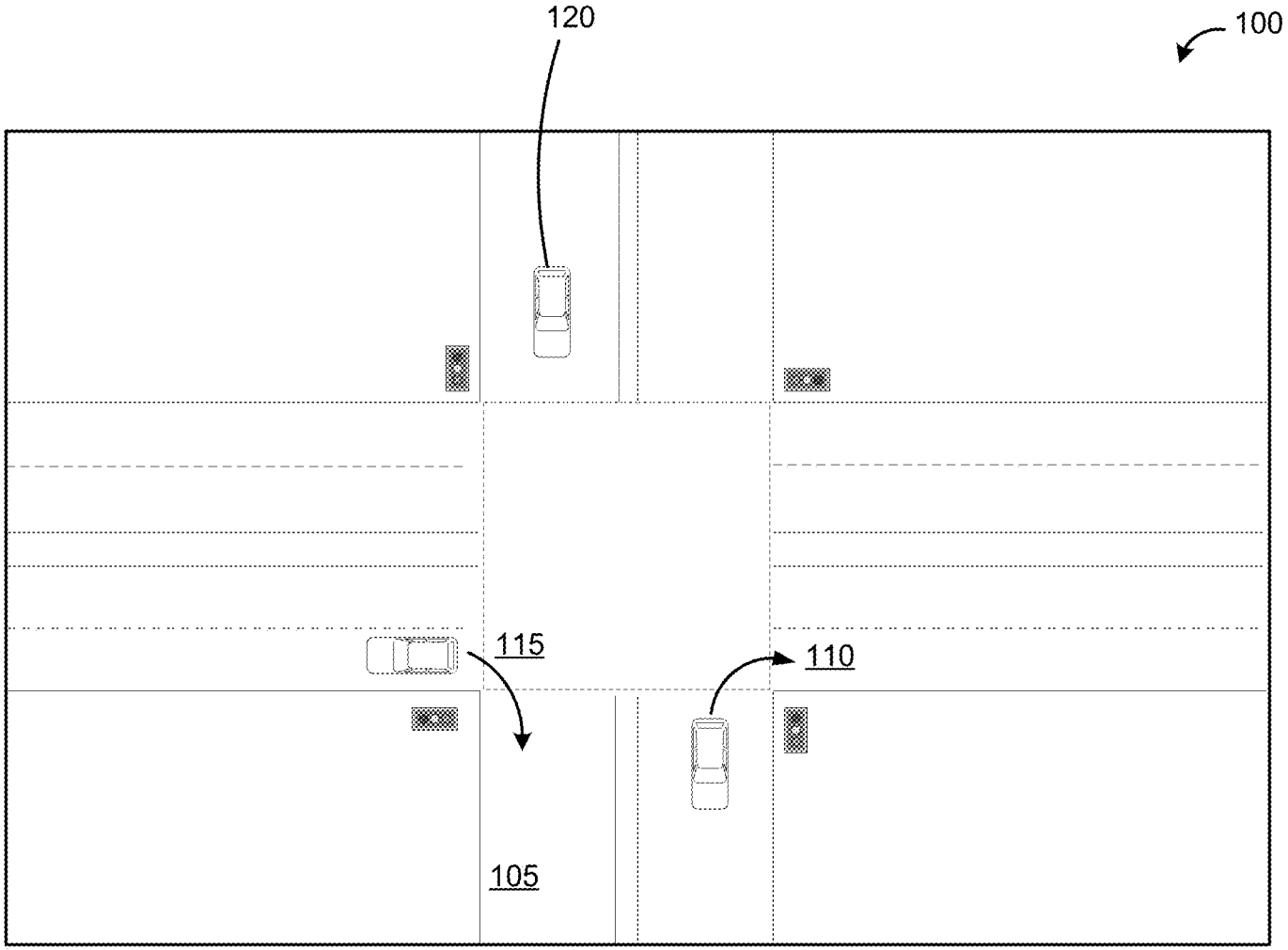
FIG. 1 shows a road network according to one example.

The skilled person in the art will understand that the drawings, described below, are for illustration purposes only. The drawings are not intended to limit the scope of the applicants' teachings in anyway. Also, it will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DESCRIPTION OF VARIOUS EMBODIMENTS

It will be appreciated that for simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail since these are known to those skilled in the art. Furthermore, it should be noted that this description is not intended to limit the scope of the embodiments described herein, but rather as merely describing one or more exemplary implementations.

It should also be noted that the terms "coupled" or "coupling" as used herein can have several different meanings depending in the context in which these terms are used. For example, the terms coupled or coupling may be used to indicate that an element or device can electrically, optically, or wirelessly send data to another element or device as well as receive data from another element or device.

The example embodiments of the systems and methods described herein may be implemented as a combination of hardware or software. In some cases, the example embodiments described herein may be implemented, at least in part, by using one or more computer programs, executing on one or more programmable devices comprising at least one processing element, and a data storage element (including volatile memory, non-volatile memory, storage elements, or any combination thereof). These devices may also have at least one input device (e.g. a keyboard, mouse, touchscreen, or the like), and at least one output device (e.g. a display screen, a printer, a wireless radio, or the like) depending on the nature of the device.

It should also be noted that there may be some elements that are used to implement at least part of one of the embodiments described herein that may be implemented via software that is written in a high-level computer programming language such as one that employs an object oriented paradigm. Accordingly, the program code may be written in Java, C++ or any other suitable programming language and may comprise modules or classes, as is known to those skilled in object oriented programming. Alternatively, or in addition thereto, some of these elements implemented via software may be written in assembly language, machine language or firmware as needed. In either case, the language may be a compiled or interpreted language.

At least some of these software programs may be stored on a storage media (e.g. a computer readable medium such as, but not limited to, ROM, magnetic disk, optical disc) or a device that is readable by a general or special purpose programmable device. The software program code, when read by the programmable device, configures the programmable device to operate in a new, specific and predefined manner in order to perform at least one of the methods described herein.

Furthermore, at least some of the programs associated with the systems and methods of the embodiments described herein may be capable of being distributed in a computer program product comprising a computer readable medium that bears computer usable instructions for one or more processors. The medium may be provided in various forms, including non-transitory forms such as, but not limited to, one or more diskettes, compact disks, tapes, chips, and magnetic and electronic storage.

The various embodiments disclosed herein generally relate to systems and methods for managing traffic flow in a road network using connected vehicle data. In at least one embodiment, a real-time traffic management platform configured to utilize real-time trip information provided by connected vehicles to manage an efficient traffic flow is disclosed.

Referring to FIG. 1, and by way of a general overview, there is a road network 100 that provides a pathway for vehicles 120. The pathway for vehicles may be, or may be called, a road, a highway, a freeway, a carriageway, a dual-carriageway, an autobahn, an autoroute, or a track, or such other synonym as may be. The pathway may be a single lane, a double lane, or more than two lanes. The pathway has a set of access points 105 which includes at least one entrance location 110 and at least one exit locations 115 at which a vehicle 120 may enter or leave the pathway. Typically, there may be many entrance and exit locations. In some cases, an access point 105 may be both an entrance location and an exit location. The vehicle 120 may enter the pathway at any entrance, and may exit the pathway at any exit. That is, the vehicle 120 may travel along the entire length of the pathway, or along only some portion thereof.

The pathways referred to herein include at least one intersection. An intersection is described as a junction where two or more roads meet or cross. The intersection may be a three-way intersection (e.g. a 'T' or a 'Y' junction, or a fork), a four-way intersection, or even as high as a seven-way intersection, etc., where each 'way' in an intersection is referred to as an 'approach'. In various embodiments disclosed herein, each intersection has one or more corresponding traffic lights (or traffic signals) for one or more approaches at the intersection.

Vehicles 120 may be human driven vehicles, semi-autonomous vehicles with self-driving capabilities or fully-autonomous vehicles. Some of the vehicles 120 using the road network 100 may be connected vehicles. By 'connected' it is meant that the vehicles 120 are monitored by a central server or a combination of servers so that various vehicle specific factors, while the vehicle is in commute, are available to the central server. Such factors may include one or more of the following information, such as origin location of the vehicle, destination location of the vehicle, current location of the vehicle, speed of the vehicle, type of the vehicle, size of the vehicle, or a combination of these, etc. Such vehicle specific factors received from various connected vehicles helps in optimizing the traffic flow on the road network 100.

The various embodiments disclosed herein may provide a multitude of advantages related to traffic management. For example, the disclosed embodiments may provide an advantage of an overall reduced travel time, which may further result in reduction of direct and indirect cost of waiting in congested traffic.

In another example, the disclosed embodiments may provide an advantage of reduction in a number of stops a vehicle has to make while on the road. This may reduce wear and tear costs, and other damages, associated with the vehicles. This may also increase vehicle safety due to the fewer stops required to be made by the vehicle and fewer number of decisions required to be made by the driver or a rider (in case of a self-driving vehicle).

In some cases, the various embodiments disclosed herein may also provide an advantage of an overall reduction of greenhouse gas emissions by the various connected vehicles. The various embodiments disclosed herein may also provide advantages of dynamic tolling implementation and efficient network load balancing.

Figure 2:
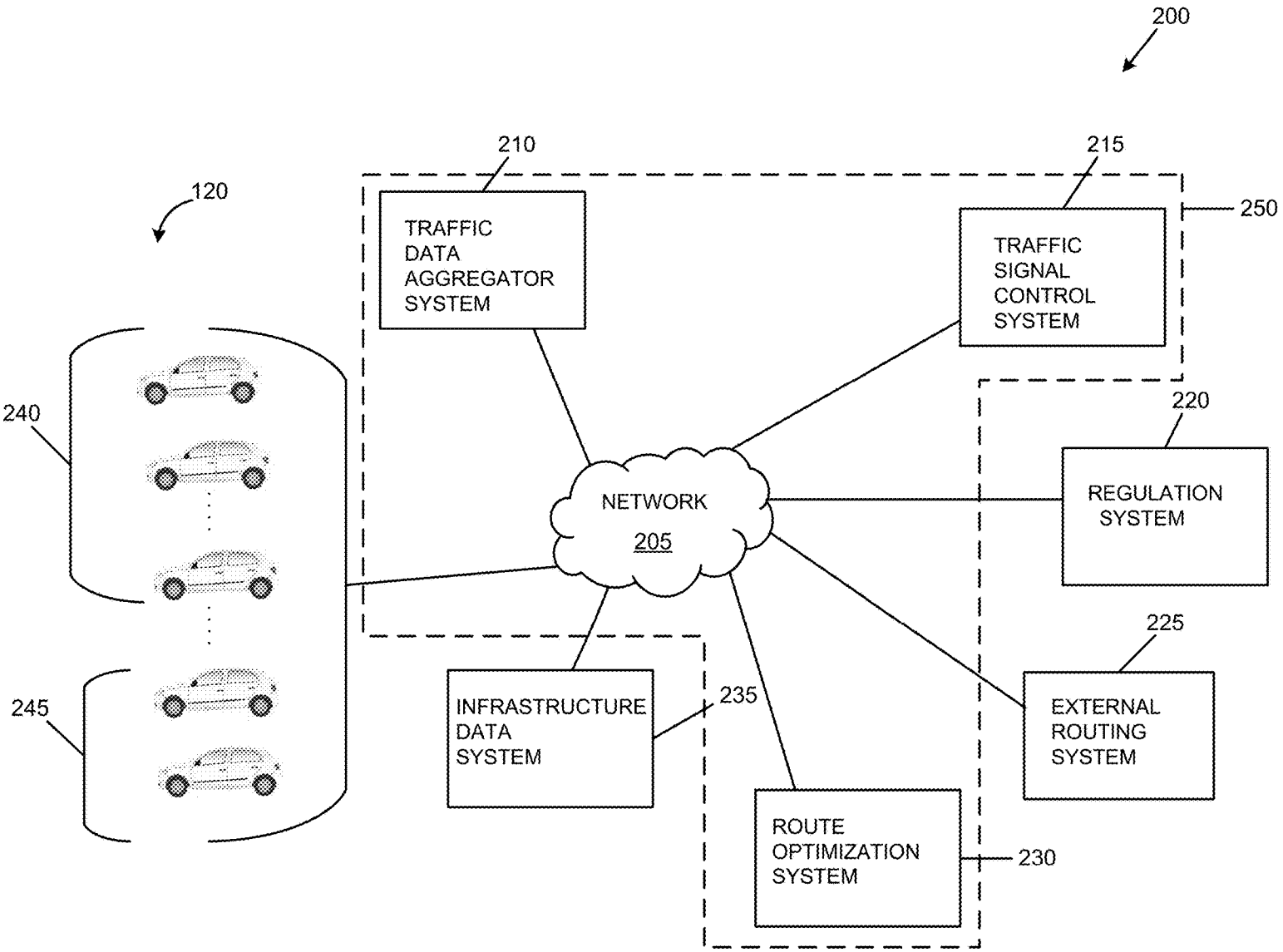
FIG. 2 is an example of a block diagram of a traffic management platform.

Reference is made to FIG. 2, which illustrates a block diagram of a traffic management platform 200 in accordance with an example embodiment. The traffic management platform 200 is provided as an example and there can be other embodiments of platform 200 with different components or a different configuration of the components described herein.

As illustrated, traffic management platform 200 includes a plurality of vehicles 120, where some are connected vehicles 240 and some are unconnected vehicles 245. Traffic management platform 200 further includes a traffic management system 250 that comprises a network 205, a traffic data aggregator system 210, a traffic signal control system 215 and an external routing system 225. The traffic management platform 200 may additionally include a regulation system 220, a route optimization system 230 and an infrastructure data system 235.

In the illustrated embodiment, the connected vehicles 240 are those that are capable of interacting with the traffic management system 250 via the network 205.

Network 205 may be any network or network components capable of carrying data including the Internet, Ethernet, plain old telephone service (POTS) line, public switch telephone network (PSTN), integrated services digital network (ISDN), digital subscriber line (DSL), coaxial cable, fiber optics, satellite, mobile, wireless (e.g. Wi-Fi, WiMAX), SS7 signaling network, fixed line, local area network (LAN), wide area network (WAN), a direct point-to-point connection, mobile data networks (e.g., Universal Mobile Telecommunications System (UMTS), 3GPP Long-Term Evolution Advanced (LTE Advanced), 5G, Worldwide Interoperability for Microwave Access (WiMAX), etc.), radiofrequency identification (RFID) systems, near frequency communication (NFC) enabled networks, short-wavelength wireless communication networks (e.g. Bluetooth®), Dedicated Short Range Communication (DSRC) and others, including any combination of these. The various components of the traffic management platform 200 interact with each other via the network 205.

The traffic management system 250 is a networked computing system that includes a processor and memory. The memory of the traffic management system 250 is configured to store instructions executable by the processor. The traffic management system 250 may be a single system or a combination of various sub-systems as illustrated in FIG. 2A. The various sub-systems may be located at one location or distributed over a geographical area.

The traffic management system 250 is configured to receive real-time vehicle information from various sources, including connected vehicles 240, in order to manage the traffic flow over a predetermined geographical area. The predetermined geographical area may include a pathway, a combination of pathways, a postal code, a town, a city, a province, or any other subset of a road network, such as road network 100.

In various embodiments, the traffic management system 250 is configured to minimize an aggregated measurement of congestion burden function associated with a road network 100. The traffic management system 250 may be configured to assess the aggregate congestion burden by using time delay or wait time as a proxy for congestion cost. The wait time may be determined based on total number of vehicles, vehicle types or number of passengers.

In various embodiments, the traffic management system 250 is configured to assess the aggregated congestion burden based on the estimated queue and estimated arrival rate of vehicles at a given intersection along a given timeline.

In various embodiments, the traffic management system 250 is configured to minimize the aggregate congestion burden associated with the road network 100 by optimizing traffic signal timing or optimizing vehicles routes, or both, as discussed in detail below.

As illustrated in FIG. 2, the traffic management system 250 includes a traffic data aggregator system 210. The traffic data aggregator system 210 is a networked computing device or a server including a processor and memory, and is capable of communicating with a network, such as network 205. The traffic data aggregator system 210 may alternatively be a distributed system including more than one networked computing devices or servers capable of communicating with each other. The distributed system implementation of the traffic data aggregator system 210 may have one or more processors with computing processing abilities and memory such as a database(s) or file system(s).

In various embodiments, the traffic data aggregator system 210 is configured to aggregate real-time trip information received from the various connected vehicles 240. In various cases, the traffic data aggregator system 210 is configured to estimate the arrival times of incoming vehicles at the various intersections in a predetermined monitored geographical area. More particularly, the traffic data aggregator system 210 is configured to estimate the arrival times of incoming vehicles at each approach of each intersection in a predetermined monitored geographical area. The traffic data aggregator system 210 may be configured to determine the arrival times to a high degree of precision by continuously updating the arrival times for each intersection or each approach.

The frequency of update of the arrival times may be pre-determined. For example, in some cases, the traffic data aggregator system 210 may be configured to determine the arrival times of various incoming vehicles at each approach of an intersection every few microseconds, seconds, minutes, or some other pre-selected denomination of time.

In some cases, the traffic data aggregator system 210 is configured to determine the arrival times of various incoming vehicles at each approach of an intersection for each movement of the vehicles.

In some embodiments, the traffic data aggregator system 210 is configured to aggregate trip information received in relation to both the connected 240 and unconnected 245 vehicles. For example, in some cases, the connected vehicles 240 may have capabilities to monitor surrounding objects, including other connected 240 and unconnected 245 vehicles.

In one embodiment, one or more connected vehicles 240 includes a sensory system, such as an advanced driver assistance system or ADAS system or a self-driving sensory system, that is configured to detect surrounding objects and do basic classification of such objects, such as into pedestrian or vehicle, or specific type of vehicle etc. In some other embodiments, one or more connected vehicles 240 may have other systems, devices or sensors, such as infrared sensors, image capturing devices, etc. to determine and potentially classify surrounding objects.

The traffic data aggregator system 210 is configured to receive data signals from one or more data sources provided within the connected vehicles 240, via network 205. Such data signals may include vehicle trip information when the vehicle 240 is on a pathway in the road network 100. For example, data signals may include one or more items such as origin location of the vehicle 240, destination location of the vehicle 240, current location of the vehicle 240, speed of the vehicle 240, type of the vehicle 240, size of the vehicle 240, etc.

One or more data sources configured to provide data signals include one or more sensors or devices located within each connected vehicle 240, such as an engine control unit (ECU), GPS sensor, accelerometer, engine speed sensor, voltage sensor, seat belt sensor, temperature sensor, and other such sources.

In some cases, the data signals received from some or all of the connected vehicles 240 may include the travel route of the connected vehicle 240. In some other cases, the data signals received from some or all of the connected vehicles 240 may include information pertaining to arrival time at some or all intersections along the route of the connected vehicle 240.

The traffic data aggregator system 210 may be additionally configured to receive historical information about arrival times and volume at various intersections or approaches in a road network 100. Such historical information may be categorized based on time of the day, day of the week, month of the year, different weather patterns, etc. Such information may be received as data signals from the external database, stored internally within the system 210, or a combination of both.

In some cases, the traffic data aggregator system 210 is configured to assign a different weight to the historical information based on different criteria. For example, if the traffic data aggregator system 210 is generating an arrival time or volume prediction for far-future time instances, then the historical information is assigned a greater weight than if the predictions were being generated for a near-future time instance. Other criteria affecting the weight assigned to the historical information may include the origin location, destination location, actual and predictive weather for the day, time of the day, day of the month, month of the year, profile of the pathway, and other such factors that can affect traffic. The weight adjustments as discussed above may provide the advantage of lowering the volatility of far-future predictions.

The traffic management system 250 is configured to receive the various data signals and create an intersection model for various intersections (including some or all) over a road network 100. The intersection model may include estimated queues, by length or time; estimated vehicle arrival times; and a predicted future timeline of traffic at the intersections.

Figure 3A:
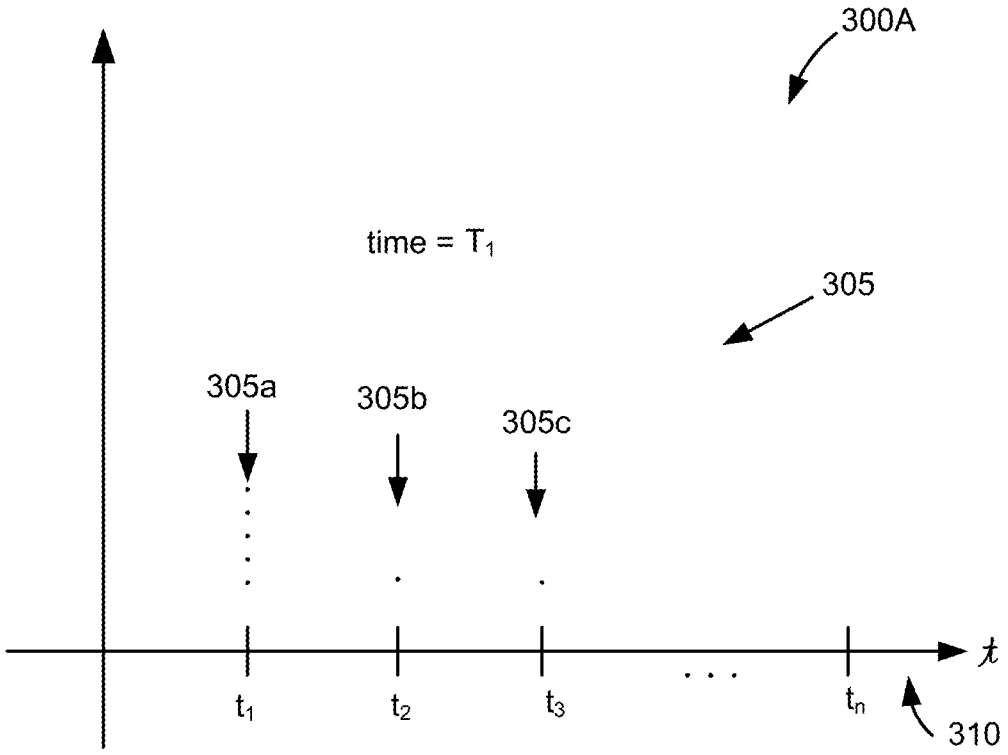
FIG. 3A shows a representation of the predictive arrival times of vehicles at an intersection according to an example.
Figure 3B:
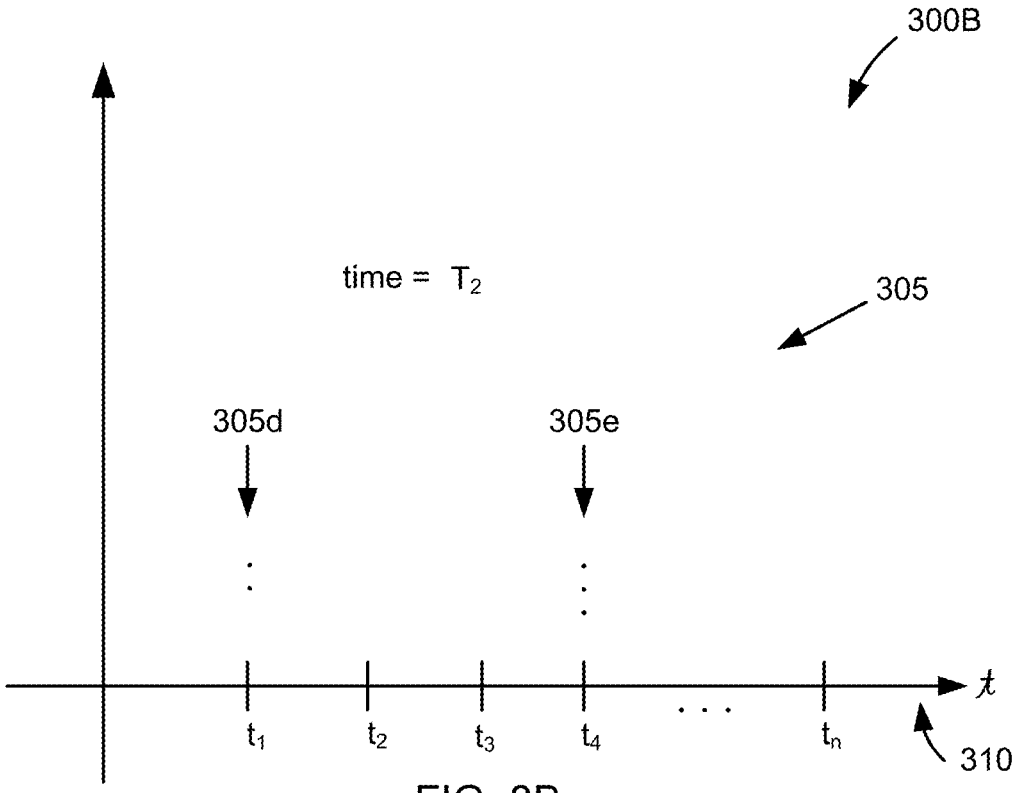
FIG. 3B shows a representation of the predictive arrival times of vehicles at an intersection according to another example.

Reference is briefly made to FIGS. 3A and 3B, which illustrate examples of graphical representation of intersection models for a particular approach of an intersection over a duration of time. For example, FIG. 3A illustrates an example of graphical representation of an intersection model for an approach at a first time instance, where time=$T_1$. FIG. 3B illustrates an example of graphical representation of an intersection model for the same approach as FIG. 3A at a second time instance, where time=$T_2$. The intersection models of FIGS. 3A and 3B show the arrival times and estimated queue lengths of various connected or unconnected vehicles over a timeline.

As illustrated in FIG. 3A, the graphical representation 300A shows the number of vehicles 305 approaching a corresponding approach over a timeline 310. The timeline 310 may extend over a few seconds, minutes or hours.

In the example illustrated in FIG. 3A, the number of vehicles 305*a* expected to arrive at a particular approach at time $t_1$ may be 30, the number of vehicles 305*b* expected to arrive at the same approach at time $t_2$ may be 10, the number of vehicles 305*c* expected to arrive at the same approach at time $t_3$ may also be 10, and so on. As illustrated, this prediction is generated at time $T_1$ 315.

At time $T_2$ 320, the traffic data aggregator system 210 updates the intersection model, as illustrated in FIG. 3B. Time $T_2$ is an instance of time that occurs after time $T_1$ of FIG. 3A. In the illustrated example, at time $T_2$, the graphical representation of the prediction of traffic arrival times is provided in graph 300B. At time $t_1$, the number of vehicles 305*d* expected to arrive at the approach is 20. At times $t_2$ and time $t_3$, no vehicles are expected to arrive at the approach. But at time $t_4$, 30 vehicles 305*e* are expected to arrive at the approach. It will be appreciated that the discussion above is intended to provide non-limiting examples of intersection models generated by the traffic data aggregator system 210.

Figure 4A:
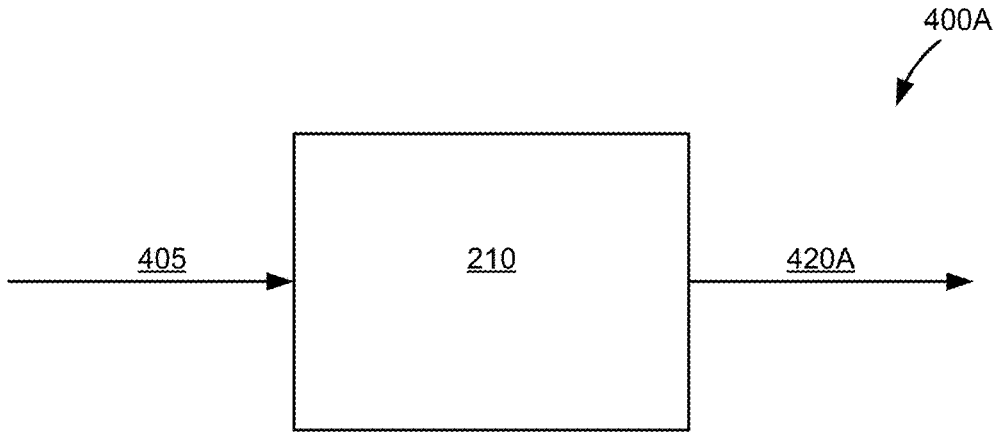
FIG. 4A shows an example of data flow associated with a traffic data aggregator system.
Figure 4B:
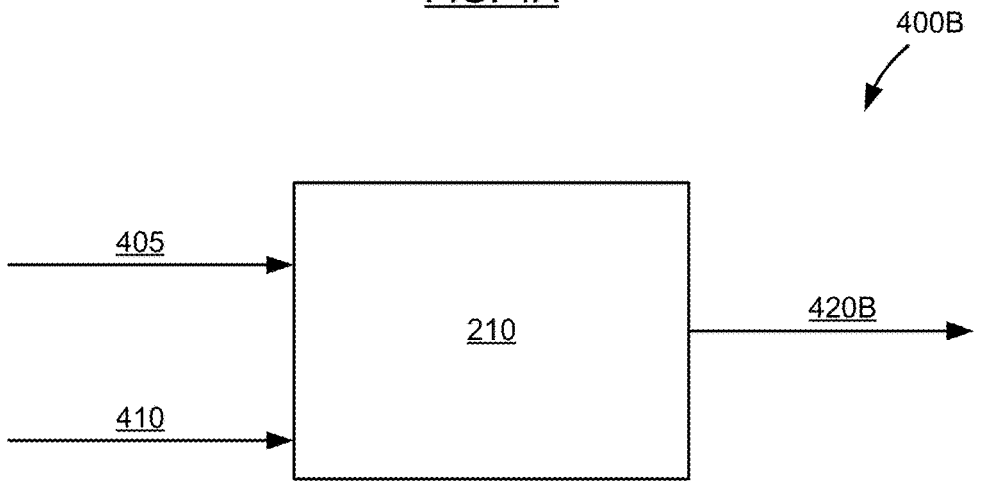
FIG. 4B shows another example of data flow associated with a traffic data aggregator system.
Figure 4C:
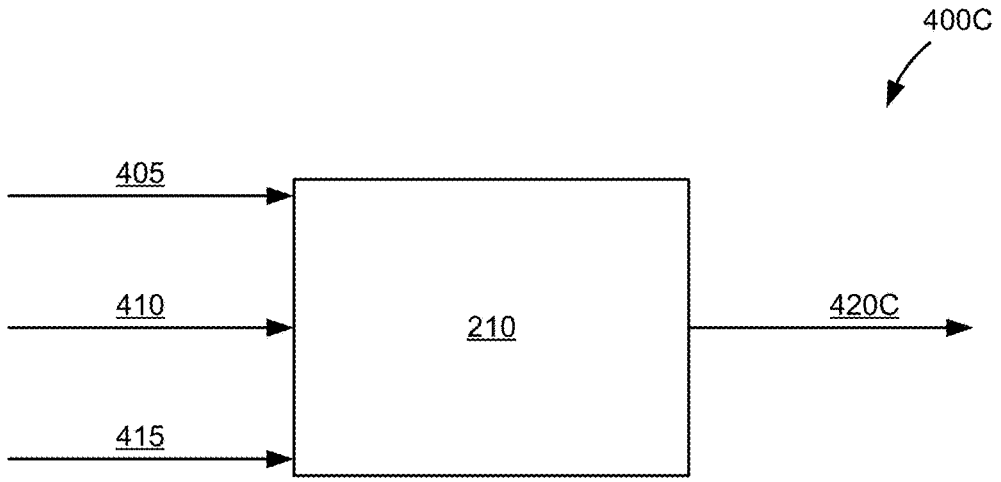
FIG. 4C shows a further example of data flow associated with a traffic data aggregator system.

Reference is next made to FIGS. 4A-4C, which illustrate various examples of data flow 400A-400C associated with the traffic data aggregator system 210.

In the example illustrated in FIG. 4A, the traffic data aggregator system 210 is configured to receive trip information signals 405 from connected vehicles 240 and about connected vehicles 240 only.

In some cases, such trip information signals 405 may include the origin and destination information associated with a connected vehicle 240. In some other cases, the trip information signals 405 may include real-time location information (e.g. via GPS) of the connected vehicle 240. In some further cases, the trip information signals 405 may additionally include speed information associated with the connected vehicle 240. In some other cases, the trip information signals 405 may include the route information associated with the connected vehicle 240.

In at least one embodiment, the trip information signal 405 received from the connected vehicles is used to determine the arrival times of the connected vehicles at the corresponding intersections along the path of the connected vehicles between the origin and destination locations. For example, if a connected vehicle encounters five intersections between the origin location and destination location, then the trip information signal 405 received from the connected vehicle is used to determine the estimated arrival time of the connected vehicle at each of the intersections along the path of the connected vehicle.

In at least one embodiment, the connected vehicle 240 is capable of determining the estimated arrival time at each intersection along the path of the connected vehicle 240. In such cases, the trip information signal 405 received by the system 210 includes the estimated arrival times associated with the corresponding connected vehicle 240.

As illustrated, the traffic data aggregator system 210 uses the information contained in the trip information signals 405 to determine an overall map 420A of the various connected vehicles 240 at various intersections over a predetermined area of the road network 100. The predetermined area may be a town, a city, a postal code or even a province or a country. The overall map 420A is generated based on individual intersection models associated with each approach of some or all intersections over the predetermined area.

Another example is illustrated in FIG. 4B, where the data flow 400B associated with the traffic data aggregator system 210 includes trip information signals 405 and secondary information signals 410 from the connected vehicles 240.

Secondary information signal 410 relates to trip information gathered by the connected vehicles with respect to other objects in their vicinity. As discussed above, some connected vehicles 240 may have sensors or systems that are capable to detecting other vehicles, connected 240 or unconnected 245, in the vicinity of the connected vehicle 240. The connected vehicle 240 may be able to detect the types of vehicle in the vicinity, the speeds of the vehicles in the vicinity, the pedestrians around the connected vehicles, the speed limits associated with the pathways, etc.

By providing secondary information signals 410 to the traffic data aggregator system 210, the traffic data aggregator system 210 is configured to provide a detailed map 420B of the road network 100. The detailed map 420B differs from 420A in that it includes estimated arrival times of some unconnected vehicles as well. An advantage of the secondary information signal 410 is that even with low a penetration of connected vehicles 240, the traffic data aggregator system 210 is capable of mapping out the pathways to a greater degree of accuracy.

Reference is next made to FIG. 4C, which illustrates another example of data flow 400C associated with the traffic data aggregator system 210. Data flow 400C shows that in addition to traffic information signal 405 and secondary information signal 410 from the connected vehicles, the traffic data aggregator system 210 is also configured to receive infrastructure data signal 415.

Infrastructure data signals 415 may be received from infrastructure data systems 235, and may include information detected by cameras (image-capturing sensors), traffic radars, LIDARs, DSRC Roadside units (RSU), or other sensors provided along various pathways in the road network. For example, major intersections typically have cameras to detect vehicle speeds in order to issue citations if the speed rules are violated. Infrastructure data systems 235 may include sensors or devices that are capable of monitoring or surveilling various pathways in a road network.

By incorporating the information from the information data signals 415, the overall map 420C generated by the traffic data aggregator system 210 is even more accurate and complete.

The overall maps 420A-420C may additionally include reporting data such as total vehicle count, average speed per intersection, average travel time per intersection, etc. Similar reporting data may be generated for the various intersections along a particular predefined path, or over the entire road network.

Figure 5:
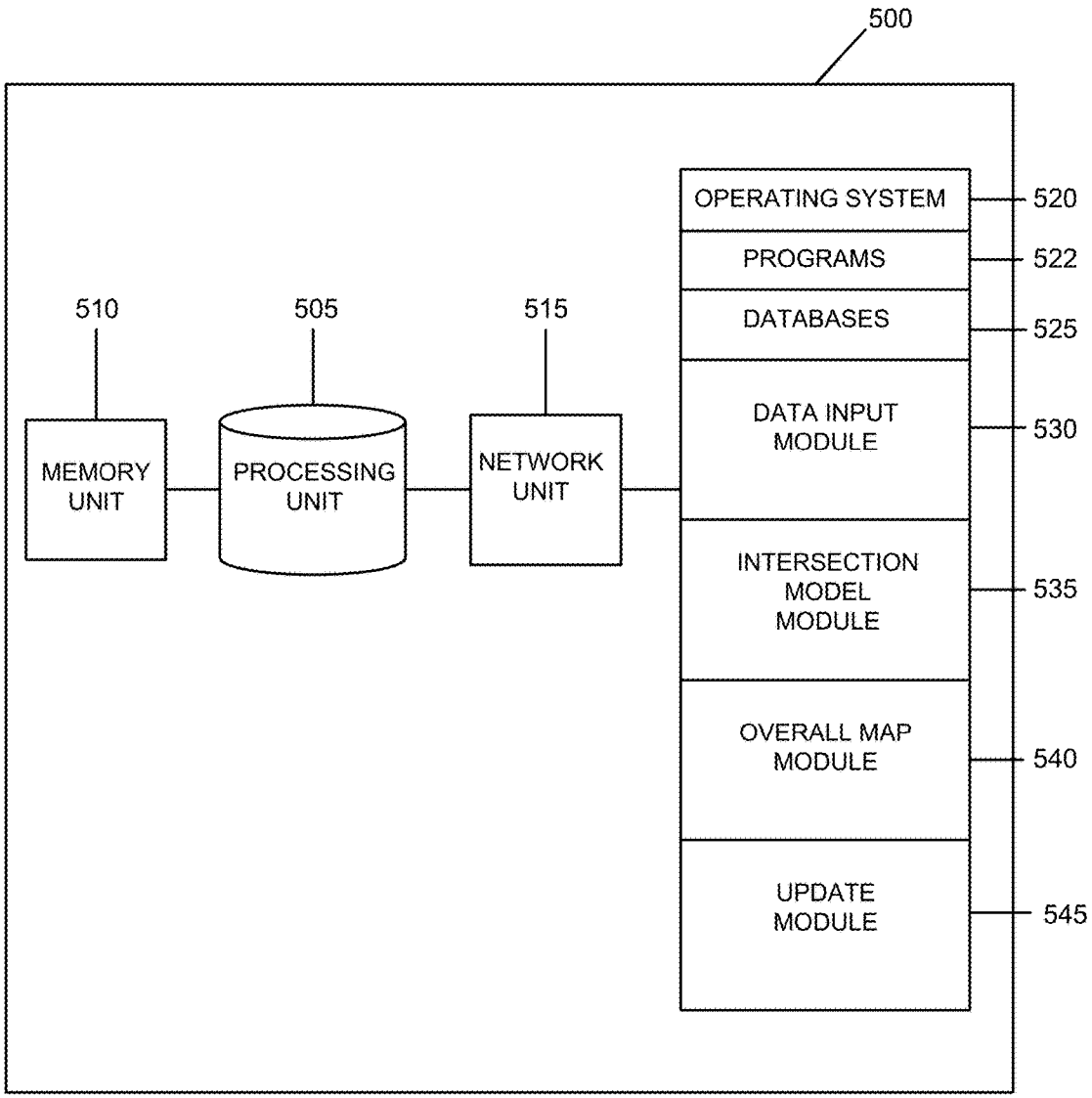
FIG. 5 shows an example of a block diagram of a traffic data aggregator system.

Reference is next made to FIG. 5, which illustrates a block diagram 500 of a traffic data aggregator system, such as the traffic data aggregator system 210, according to an example. The block diagram 500 of the traffic data aggregator system comprises a processing unit 505, a memory unit 510 and a network unit 515. The memory unit 510 can include RAM, ROM, one or more hard drives, one or more flash drives or some other suitable data storage elements such as disk drives, etc. The memory unit 510 is used to store an operating system 520 and programs 522 as is commonly known by those skilled in the art. For instance, the operating system 520 provides various basic operational processes for the operation of the traffic data aggregator system.

The memory unit 510 may also accept data from one of the data input module 530, the intersection model module 535, the overall map module 540 and update module 545.

The memory unit 515 may also accept data from one of the data input module 530, the intersection model module 535, the overall map module 540 and update module 545.

The data input module 530 is configured to receive data signals from various sources, including connected vehicles, external databases, etc. The data signals may include traffic information signals 405 as discussed above. The data signals may additionally include secondary information signals 410, infrastructure data signals 415, or both, as discussed above.

The intersection model module 535 is configured to generate an intersection model per approach intersection in a road network. For each intersection, the intersection model may include estimated arrival times of the various connected or unconnected vehicles, and/or average queue lengths at various time instances, including future time instances, at each approach of the intersection.

The overall map module 540 is configured to generate an overall map of two or more intersections in a predefined area within the entire road network. The overall map may be generated for each connected vehicle to show the state of traffic flow at various intersections along the path of travel for the connected vehicle. Other maps, covering other predefined areas in a road network, may also be generated by the module 540.

The update module 545 is configured to determine if a predetermined duration of time since the previous intersection model or overall map generation has expired. The update module 545 may be configured to update the intersection model every few seconds or minutes to make sure that the traffic flow information stays relevant.

Figure 6:
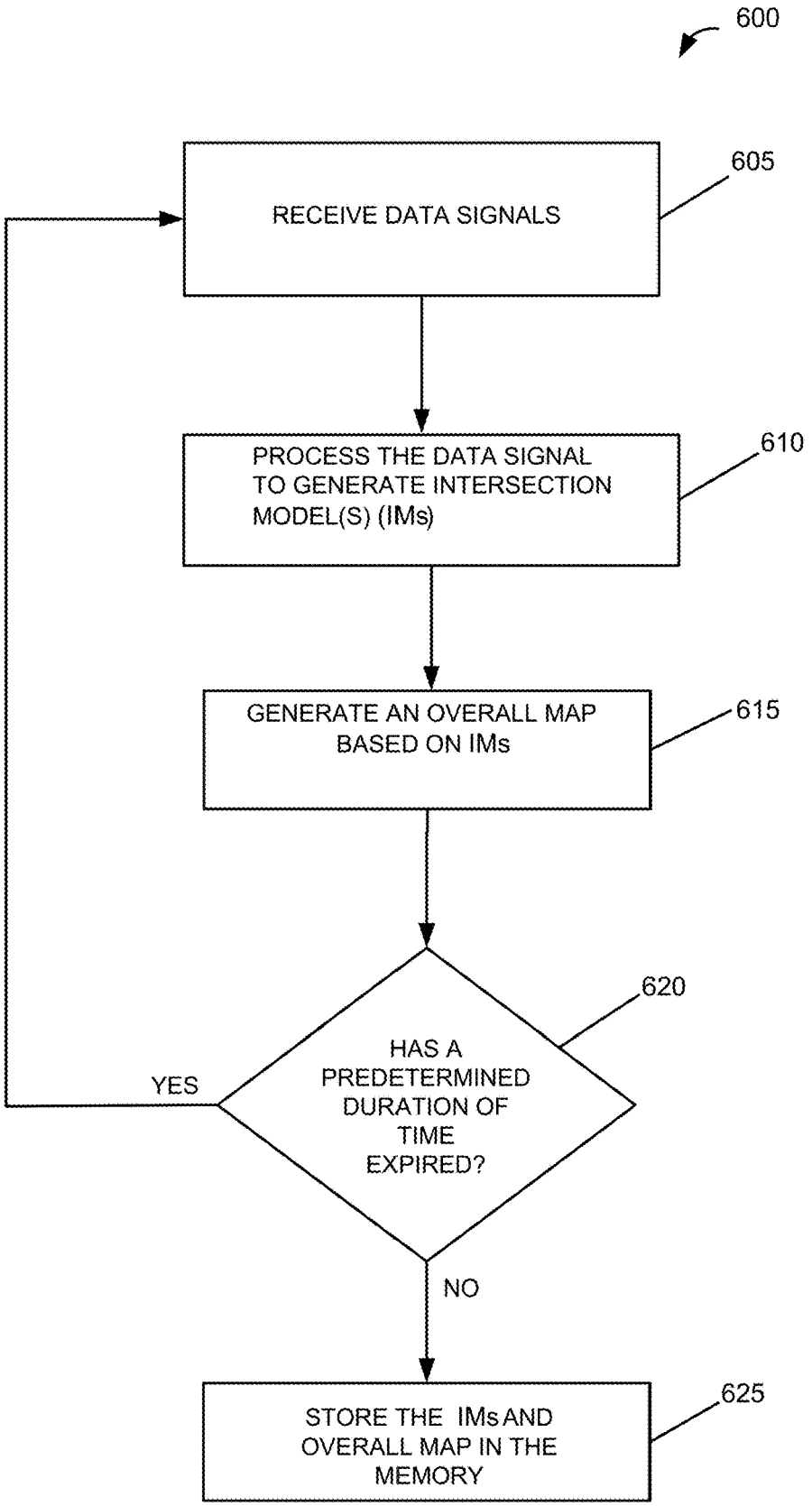
FIG. 6 shows an example of a process flow diagram for the traffic data aggregator system of FIG. 5.

Reference is next made to FIG. 6, which illustrates an example of a process flow diagram 600 of a traffic data aggregator system, such as the traffic data aggregator system 210 of FIG. 2 according to the teachings herein.

Process flow 600 begins at 605, where the traffic data aggregator system receives data signals from various sources, such as connected vehicles, external databases, etc. The data signals may include trip specific information associated with the connected vehicles, secondary information about surrounding connected or unconnected vehicles, intersection or pathway specific infrastructure from external sources, or a combination of these.

At 610, the traffic data aggregator system processes the received data signals and generates an intersection model for each approach at some or all intersections in a road network. The intersection model may include estimated arrival times of the various connected or unconnected vehicles at each approach at an intersection, average queue lengths at a time instance at each approach at the intersection, predicted future timeline of traffic at each approach at the intersection or a combination of these.

At 615, the traffic data aggregator system compiles the intersection models generated for each approach or intersection, and generate an overall map of the various intersections in a road network. In some cases, the overall map may be generated for a predefined geographical area that may include two or more intersections, but may be a smaller area than the entire road network.

At 620, the traffic data aggregator system determines if a predetermined duration of time since the previous generation of the intersection model or the overall map has expired. If so, then the process proceeds to 605, where the new data signals are received by the traffic data aggregator system to generate updated intersection models and road network maps. If not, then the process proceeds to 625, where the overall map and optionally the intersection models are stored in the memory within the traffic data aggregator system.

Reference is against made to FIG. 2, which illustrates a traffic signal control system 215 in the traffic management system 250.

The traffic signal control system 215 is a networked computing device or a server including a processor and memory, and is capable of communicating with a network, such as network 205. The traffic signal control system 215 may alternatively be a distributed system including more than one networked computing devices or servers capable of communicating with each other. The distributed system implementation of the traffic signal control system 215 may have one or more processors with computing processing abilities and memory such as a database(s) or file system(s).

In various embodiments disclosed herein, the traffic signal control system 215 is configured to interact with the traffic data aggregator system 210, and use the generated intersection models for various approaches to control the traffic lights at one or more intersections.

In at least one embodiment, the traffic signal control system 215 is configured to receive the vehicle arrival time information for each intersection it controls and adjust signal timings at the intersections with a goal to optimize the aggregated congestion burden.

The traffic signal control system 215 may control the traffic lights at each intersection by controlling the time instances when the one or more traffic lights at each intersection turns red, green and yellow. The traffic signal control system 215 may further determine the duration of time for which the right turn signal or the left turn signal should be activated.

In some cases, the traffic signal control system 215 generates one traffic timing data signal for all traffic lights at an intersection. In some other cases, the traffic signal control system 215 generates one traffic timing data signal for each traffic light at an intersection. In both scenarios, the traffic timing data signal includes instructions to control the operation of the traffic lights at an intersection.

In various cases, the traffic signal control system 215 controls the operation of the traffic lights at an intersections based on restrictions associated with traffic signal operation. Such restrictions may be stored and provided by a regulation system operated and maintained by a regulation authority or a third party receiving information form a regulation authority, such as the regulation system 220.

A regulation authority may include any regional, provincial, federal and/or international (e.g. United Nations) body. Regulation system 220 is configured to provide regulatory information, such as standards, codes, statues, regulations, policies, laws etc., corresponding to operation of traffic signals at an intersection.

Some non-limiting examples of information provided by the regulation system 220 include phase minimum parameter, phase maximum parameter, pedestrian crossing parameter, corridor phase coordination parameter etc. The phase minimum parameter may specify the minimum required duration of time for which each phase (e.g. green signal, red signal, left turn signal, right turn signal etc.) should last. Similarly, the phase maximum parameter may specify the maximum required duration of time for which each phase should last. Minimum pedestrian crossing parameter may specify the minimum required duration of time for which the pedestrian crossing at a given intersection should be active.

Corridor phase coordination parameter governs the operation of traffic signals in a predefined corridor, where the corridor may be described as a combination of pathways and their corresponding traffic signals in a geographical location. In some cases, a corridor may define a "green tunnel" where the various traffic signals in the corridor are coordinated with each other to turn "green" allowing numerous vehicles to pass through without slowing down or stopping. In one example, the corridor phase coordination parameter may specify the duration of time for which the "green tunnel" stays activated.

In some cases, the restrictions relating to operation of the traffic lights at the intersections may be stored in the memory of the traffic signal control system 215, and may be regularly updated by an operator.

In various embodiments, the traffic signal control system 215 receives the arrival times of various vehicles at various approaches at an intersection, and generates, for each intersection, many candidate traffic timing data signals. The traffic signal control system 215 then processes the plurality of candidate traffic timing data signals to remove or discard the candidates that invalidate intersection restrictions and rules, as discussed above.

The traffic signal control system 215 is then configured to select the best traffic timing data signal from the various candidates. The traffic signal control system 215 may select the best option based on a predetermined criteria. For example, in some cases, the predetermined criteria may be to select the traffic timing data signal that has an impact of reducing the overall arrival time of the incoming vehicles in the red phase scenario in the road network.

The traffic signal control system 215 may be configured to process the information about the arrival times of incoming vehicles at each approach of an intersection based on the previous traffic timing data signal to estimate how many incoming vehicles will arrive each approach at an intersection when the corresponding traffic light is turned red. The traffic signal control system 215 may then select the traffic timing data signal that has an impact of reducing the overall arrival times at an intersection in the red phase (i.e. the arrival times for each approach at an intersection is taken into account to determine the impact of overall reduction in arrival times in red phase). The traffic signal control system 215 may alternatively select the traffic timing data signal that has an impact of reducing the overall arrival times over the road network in the red phase (i.e. the arrival times of each intersection is taken into account to determine the impact of overall reduction in arrival times in red phase).

In another example, the predetermined criteria may include the selection of the option that provides a minimum overall waiting time for all intersections in the road network. In this example, the total waiting time may be determined by determining the queue length at each approach of an intersection for various traffic timing data signal candidates, and selecting traffic timing data signal candidate that results in the minimum overall waiting time either at an intersection, or the road network.

In some cases, the traffic signal control system 215 may generate traffic signal timing for current cycle as well as the next cycle. In some other cases, the traffic signal control system 215 may generate traffic signal timing for current cycle only.

In some cases, the traffic signal control system 215 may take into account a tolerance criteria associated with traffic signal timing adjustment experienced by the connected vehicles. The tolerance criteria may be a predefined criteria, changeable by an operator of the traffic management system 250.

In some cases, the tolerance criteria may relate to aggressiveness of adjustment of traffic signal phases. In such cases, a higher tolerance may result in a system that may readjust the traffic signal timings rather aggressively. A lower tolerance may result in a system that readjusts the traffic signal timings in a less aggressive manner. By avoiding too much fluctuations in intersection timings, conditions of ripple effects in the network resulting in instability of traffic conditions and other adverse effects may be reduced. In some other cases, the tolerance criteria may relate to allowance or omissions of certain turns or movements at an intersection. In some further cases, the tolerance criteria may relate to restrictions on the arrangement of certain turns or movements at an intersection.

Figure 7:
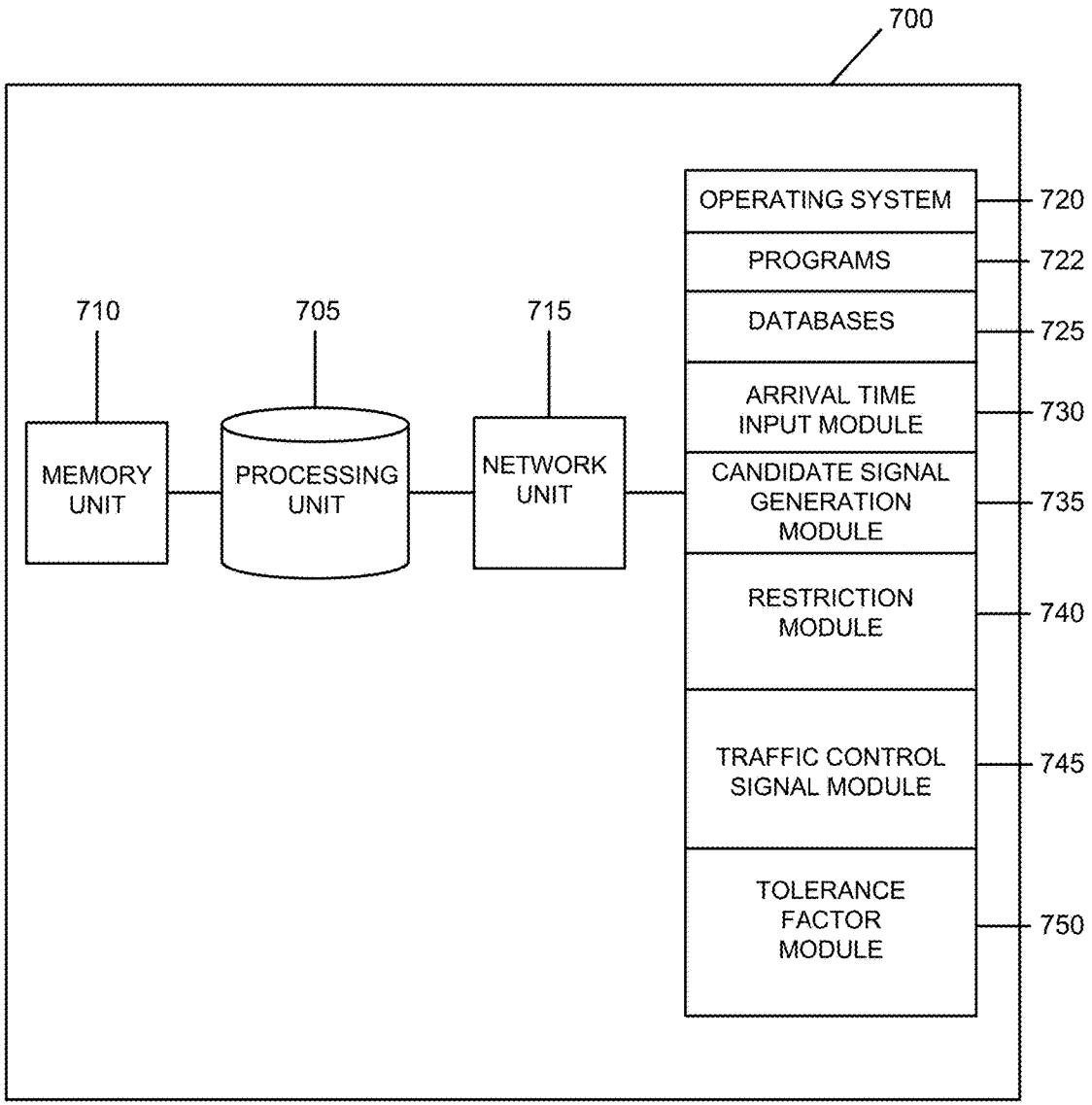
FIG. 7 shows an example of a block diagram of a traffic signal control system.

Reference is next made to FIG. 7, which illustrates a block diagram 700 of a traffic signal control system, such as the traffic signal control system 215, according to an example. The block diagram 700 of the traffic signal control system comprises a processing unit 705, a memory unit 710 and a network unit 715. The memory unit 705 can include RAM, ROM, one or more hard drives, one or more flash drives or some other suitable data storage elements such as disk drives, etc. The memory unit 715 is used to store an operating system 720 and programs 722 as is commonly known by those skilled in the art. For instance, the operating system 720 provides various basic operational processes for the operation of the traffic data aggregator system.

The memory unit 715 may also accept data from one of the arrival time input module 730, the candidate signal generation module 735, the restriction module 740, the traffic control signal module 745 and tolerance factor module 750.

The arrival time input module 730 is configured to receive arrival time information from a traffic data aggregator system, such as the traffic data aggregator system 210 of FIG. 2. The arrival time information relates to determined arrival times at each approach of each intersection in a road network. In some cases, the arrival time input module 730 may receive queue length and time information for each approach at each intersection in a road network.

The candidate signal generation module 735 may be configured to generate a list of possible variations of timing for the traffic signal at each intersection for a cycle corresponding to the duration of time to which the information received from the traffic data aggregator system corresponds. The list of variations may be generated for each traffic signal at each approach at an intersection. In addition, the list of variations may be generated as candidate traffic timing data signals.

The restriction module 740 may include rules and regulations, prescribed by an authorized party, with respect to operation of a traffic light at an intersection. The restriction module 740 may be configured to receive the regulation information from an external database or a server. The restriction module 740 may store such regulation information.

The restriction module 740 is additionally configured to filter the candidate traffic timing data signals or the list of possible variations of timings to remove the options that violate the regulations corresponding to the control and operation of traffic signals.

The traffic control signal module 745 is configured to select the best traffic timing data signal or the timing variation option that optimizes the congestion burden. The traffic control signal module 745 may select the best option based on a predetermined criteria, as discussed above. One example criteria may relate to minimizing arrival of vehicles in red phase of the traffic signal in all approaches. Another example criteria may relate to minimizing the total waiting time at an intersection in all approaches. In some other cases, the criteria may be based on the overall road network, where, for example, the overall waiting time of the road network is minimized.

The tolerance factor module 750 may be an optional module that includes a predetermined tolerance factor associated with the system 215. The predetermined tolerance factor may determine the frequency of fluctuations in an intersection timing updates. An aggressive tolerance factor may allow for a more frequent or more aggressive update to the traffic signal timing in each cycle.

Figure 8:
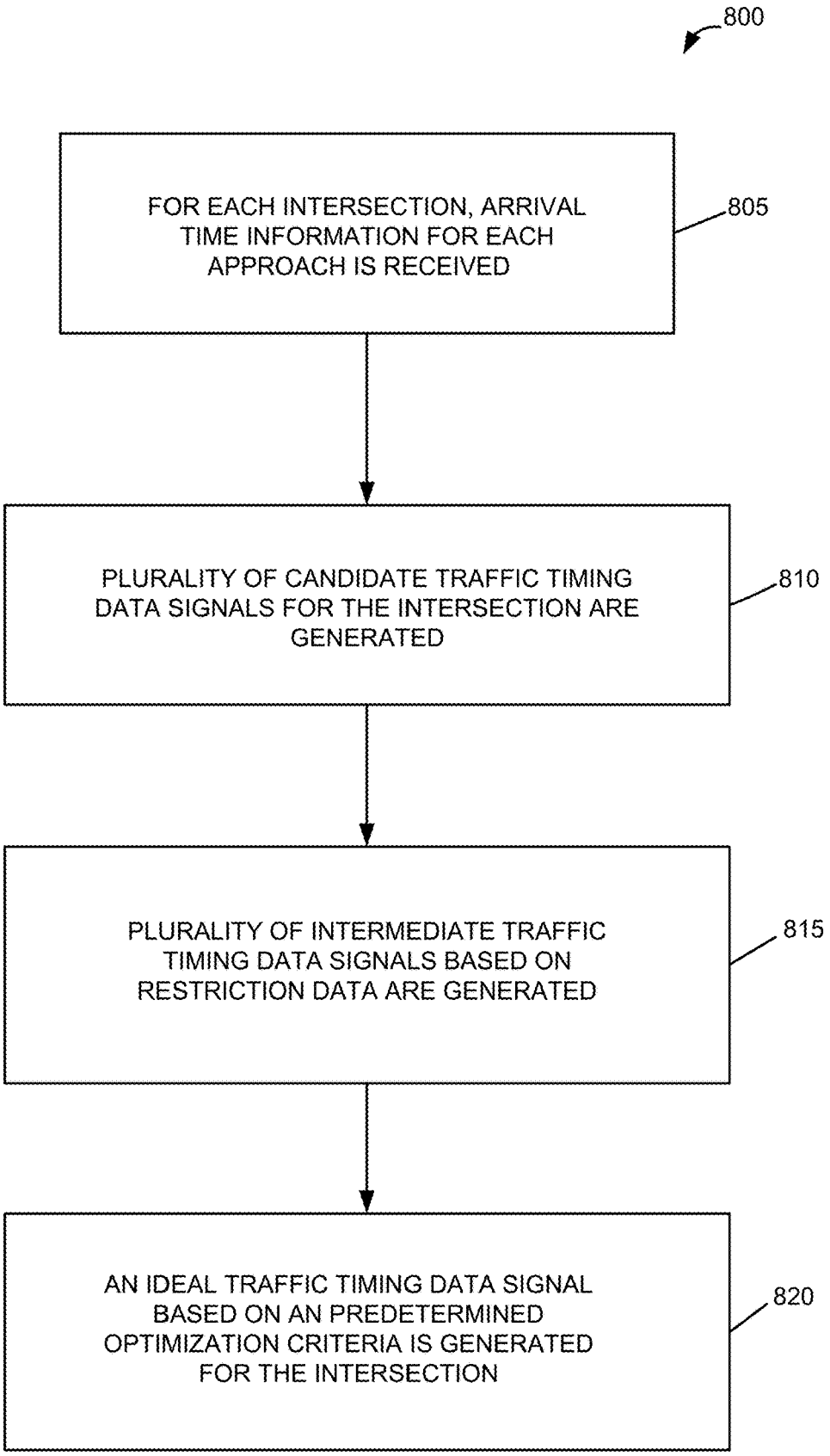
FIG. 8 shows an example of a process flow diagram for the traffic signal control system of FIG. 7.

Reference is next made to FIG. 8, which illustrates an example of a process flow diagram 800 of a traffic signal control system, such as the traffic signal control system 215 of FIG. 2 according to the teachings herein.

Process flow 800 begins at 805, where for each intersection, the traffic signal control system receives vehicle arrival time information from a traffic data aggregator system, such as the traffic data aggregator system 210. The vehicle arrival times are received for each approach at the intersection.

At 810, the traffic signal control system generates a plurality of candidate traffic timing data signals for controlling the traffic lights at the intersection. In some cases, a traffic timing data signal includes control instructions for the traffic lights of all approaches at an intersection. In some other cases, a traffic timing data signal includes control instructions for each traffic light at a corresponding approach at an intersection. In this case, a set of plurality of candidate traffic timing data is generated for each traffic light at each corresponding approach at the intersection.

At 815, the traffic signal control system filters the plurality of candidate traffic timing data signals to generate a plurality of intermediate traffic timing data signals. The intermediate traffic timing data signals are generated by filtering out those traffic timing data signals that violate the prescribed regulations (and rules) regarding traffic light operation and control.

At 820, the ideal traffic timing data signal is generated from the intermediate traffic timing data signals based on a predetermined criteria, as discussed above. At 825, the generated ideal traffic timing data signal controls the corresponding traffic light or lights at the intersection.

In some cases, a single traffic signal controller is provided per intersection, and the traffic signal controller receives the ideal traffic timing data signal that includes control instructions for the different phases and approaches at the intersection. The traffic signal controller then executes the control instructions included in the received signal to control the phases at the various traffic signals corresponding to the various approaches at the intersection.

In some other cases, multiple traffic signal controllers are provided per intersection (e.g. one controller per approach), and each traffic signal controller receives the ideal traffic timing data signal that includes control instructions for the different phases and approaches at the intersection. Each controller then executes the instructions for the corresponding approach it controls.

Reference is again made to FIG. 2, which illustrates a route optimization system 230 as part of the traffic management system 250. Route optimization system 230 is a networked computing device or a server including a processor and memory, and is capable of communicating with a network, such as network 205. The route optimization system 230 may alternatively be a distributed system including more than one networked computing devices or servers capable of communicating with each other. The distributed system implementation of the route optimization system 230 may have one or more processors with computing processing abilities and memory such as a database(s) or file system(s). In various embodiments, the route optimization system 230 is configured to determine and communicate adjust travel routes to one or more connected vehicles, such as connected vehicles 240.

In one embodiment, the route optimization system 230 is configured to determine the optimized route for connected vehicles based on a plurality of route selection criteria. One example of a route selection criteria includes the determination of current congestion level on the pathway or pathways to be used by a connected vehicle, such as vehicle 240. The current congestion level may be determined by comparing a free-flow averaged travel time on the pathway or pathways (based on historical data, for example) to current averaged travel time on the corresponding pathway(s). The current averaged travel time may be based on trip data signals received from various connected vehicles (or optionally from the infrastructure along the corresponding pathway (s)) by a traffic data aggregator system, such as the system 210. In some cases, the congestion level may be determined by comparing the free-flow averaged speed of the connected vehicle to the current averaged speed of the connected vehicle.

In some cases, an example of a route selection criteria includes a priority level corresponding to a connected vehicle on a pathway. The priority levels may be automatically assigned by an operator in some cases, and may be assigned based on a subscription requiring payment in some other cases.

For example, certain vehicles, such as emergency vehicles (e.g. ambulance, fire trucks, police cars etc.), may be automatically assigned a high priority level by an operator. In another example, public transit vehicles, including buses, subways, streetcars, trains etc., may be automatically assigned a high priority level by an operator.

The high priority level for one or both of emergency vehicles and public transit may be changed by the operator based on factors such as time of day, government regulations, weather conditions etc.

In some other cases, a driver or a rider of a connected vehicle (e.g. rider in the case of an autonomous vehicle) may change the subscription status of the corresponding vehicle to a higher priority level. The payment associated with the subscription may be predetermined by the operator, and disclosed to the driver or the rider before changing the subscription status.

In some cases, emergency vehicles and/or public transit vehicles may share the same privileges as connected vehicles subscribing to a higher priority level. In some other cases, the emergency vehicles and/or public transit vehicles may have more privileges than connected vehicles subscribing to a higher priority level. The priority level may or may not be changeable during a trip from the origin location to the destination location.

Privileges associated by a connected vehicle with a high priority level may include one or more of selection of fastest route between the origin and destination locations, maximized green light at the intersections approached by the connected vehicle, minimized queue lengths at the intersections approached by the connected vehicle, minimized overall wait times associated with the connected vehicle, minimized number of stops associated with the connected vehicles, etc.

In some cases, the privileges associated with a connected vehicle subscribing to a higher priority level may be varied based on factors such as current level of traffic, number of vehicle occupants in the connected vehicle, vehicle type corresponding to the connected vehicle etc.

In some cases, the traffic management system 250 generally or the route optimization system 230 specifically may include a degradation parameter that may be predetermined and changeable by an operator. The degradation parameter may be adjusted to determine the impact that privileges associated with higher priority level vehicles have on overall or global traffic or route optimization. For example a higher degradation value may provide more privileges to the vehicle with high priority level compared to the overall traffic or route optimization than a lower degradation value.

In some cases, the payment associated with the priority level subscription may not be charged from the driver or the rider of the connected vehicle if the privileges associated with the subscribed priority level are not discharged. For example, if the degradation parameter is adjusted to a lower value, then the probability of providing all the privileges to the connected vehicle subscribing to a corresponding high priority level may decrease. In such cases, the driver or the rider may not be charged for the services (corresponding to the high priority level privileges) not provided.

In some cases, the payment associated with the payment level subscription may be based on additional factors, such as type of vehicle, number of occupants in the vehicle etc. For example, even with a same priority level, a first connected vehicle with only one occupant will be charged more than a second connected vehicle with four occupants. Similarly a commercial vehicle, such as a truck carrying a cargo container, may be charged more than a non-commercial vehicle, even if both the commercial and the non-commercial vehicles are subscribed to a higher priority level. Such factors may be predefined by the operator.

Another example of a route selection criteria includes a level of service (LoS). The current LoS may be determined based on the averaged travel time of a connected vehicle on a pathway. The current LoS may be compared against a desired LoS to optimize the route associated with the connected vehicle. In some cases, different connected vehicles may have a different priority level within a traffic management platform, such as platform 200, as discussed above. In such cases, different priority levels may be associated with a predetermined desired LoS.

Yet another example of a route selection criteria includes road restrictions, such as road closures or restrictions per mode of transportation or vehicle type. Road restrictions are typically applied during construction events, impactful events (such as sporting events, art performances, concerts or major conferences). Road restrictions may also be applied to provide high LoS for certain modes of transportation (e.g. Toronto Downtown King Street pilot program providing a higher LoS for public transportation).

Similarly, another criteria may include tolling information. Under this criteria, the traffic information including current level of congestion and/or current and desired LoS per connected vehicle on each pathway may be provided to a toll rate calculation system, which may be an external system. This external system may be configured to determine a dynamic or static toll rate associated with the pathway, and the toll rated per pathway and per vehicle priority level is provided to the route optimization system 230.

Other criteria that may be adopted by the route optimization system 230 may include certain rules. A few non-limiting examples of such rules are provided here. For example, restricted pathways may be avoided for some or all connected vehicles, optionally based on their corresponding priority level. Tolled routes or pathways may be avoided. In another example, if the quickest route suffers from degraded traffic conditions or degraded LoS, an alternative route is determined.

Similarly, in another example, if a portion of the connected vehicles need to be routed to maintain the level of service on network roads, the route optimization system may be configured to select the vehicle or vehicles to be routed randomly. In some cases, the route optimization system may select the vehicle(s) to be routed based on a factor such as the least number of passengers or occupants in the vehicle.

In some cases, the route optimization system 230 may be configured to explore the available alternative routes for a selected vehicle or vehicles with the goal of minimizing the overall travel time for all connected vehicles within the road network. In some other cases, driver or the rider of the connected vehicle receiving the alternative route information may be asked to provide a feedback indicating the occupant's preference, such as whether the driver or rider wants to use the alternative route, or pay a toll for the quickest path. As discussed above, in some cases, the driver or the rider may be triggered to subscribe to a priority level as soon as the driver or the rider get onboard, and the preferences of the driver or the rider are gauged from the selected priority level. In such cases, no further triggers are provided to the driver or the rider while on route to the destination location.

In some cases, the alternative route provided to the connected vehicles may be provided based on a certain threshold. For example, a certain threshold for degradation of travel time (e.g. 20% of the quickest travel time) may be used to limit the selection and recommendation of the alternative path.

In some cases, the route optimization system 230 may be configured to receive route options from an external routing system, such as the external routing system 225 of FIG. 2. External routing system 225 may be a third-party database capable of providing alternative route information between the indicated origin location and the destination location of a connected vehicle. The external routing system 225 may alternatively provide alternative route information based on the indicated current location and the destination location of the connected vehicle. In such cases, the route optimization system 230 may process the various alternative routes proposed by the external system, and determine the ideal route for the connected vehicle. The ideal route is then transmitted to the connected vehicle.

Figure 9:
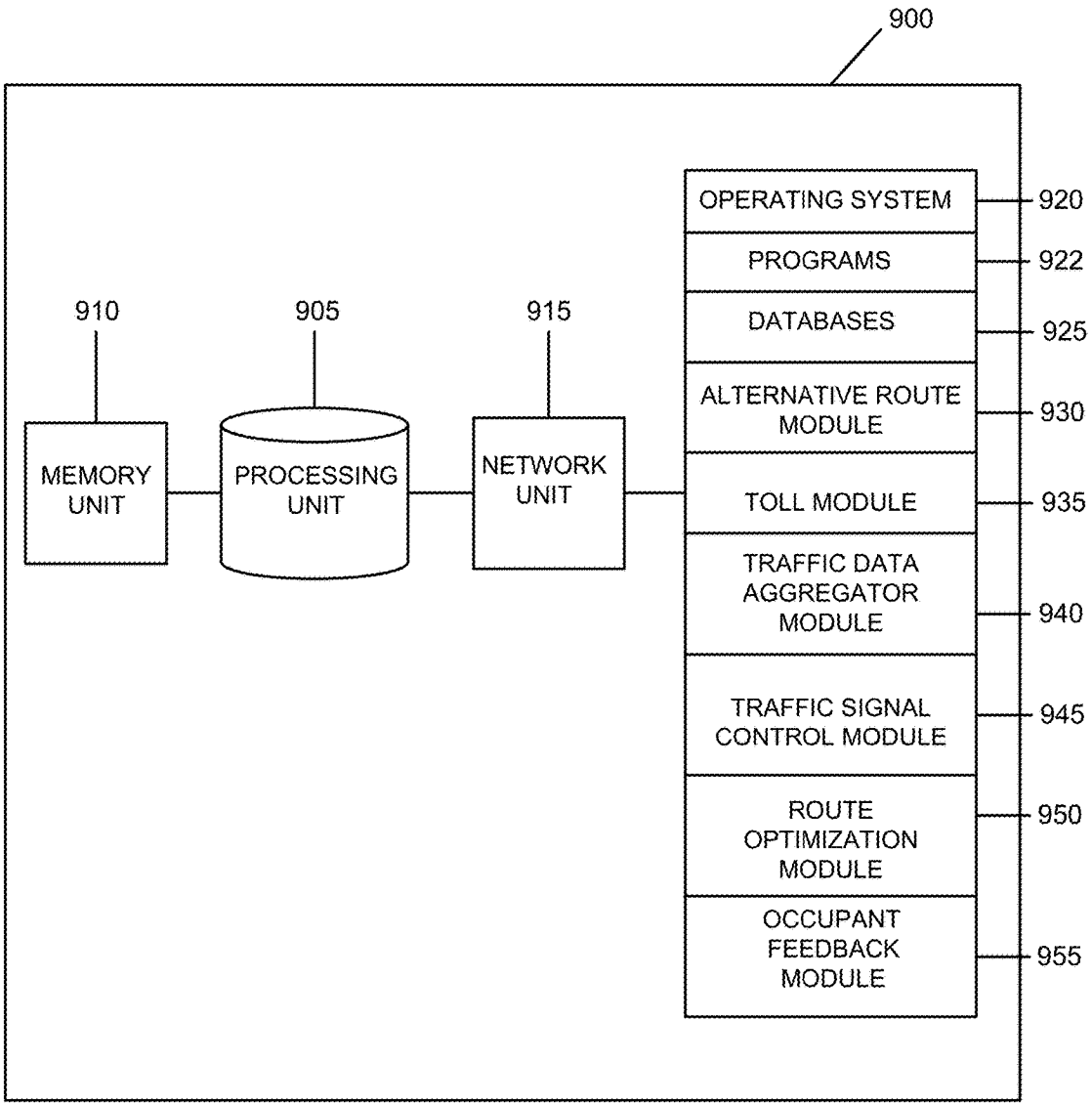
FIG. 9 shows an example of a block diagram for a route optimization system.

Reference is next made to FIG. 9, which illustrates a block diagram 900 of a route optimization system, such as the route optimization system 230, according to an example. The block diagram 900 of the route optimization system comprises a processing unit 905, a memory unit 910 and a network unit 915. The memory unit 905 can include RAM, ROM, one or more hard drives, one or more flash drives or some other suitable data storage elements such as disk drives, etc. The memory unit 915 is used to store an operating system 920 and programs 922 as is commonly known by those skilled in the art. For instance, the operating system 920 provides various basic operational processes for the operation of the route optimization system.

The memory unit 915 may also accept data from one of the alternative route module 930, the toll module 935, the traffic data aggregator module 940, traffic signal control module 945, the route optimization module 950, and occupant feedback module 955.

The alternative route module 930 may be configured to determine alternative routes between the origin location (or current location) and the destination location of a connected vehicle. In some other cases, the alternative route module 930 may receive this information from an external database.

The toll module 935 may be configured to receive static or dynamic toll information (e.g. toll rates) for the connected vehicle on a road segment along the path of travel for the connected vehicle. The toll information may be received from an external system. In some case, the toll module 935 may be configured to generate such toll information based on guidelines received from external systems.

The traffic data aggregator module 940 may be configured to receive traffic related information from a traffic data aggregator module, such as module 210 of FIG. 2. The traffic data aggregator module 940 may be configured to receive the queue estimates, arrival time estimates or other such data, and determine parameters such as current congestion level on the pathway, current LoS on the pathway, desired LoS on the pathway etc.

The traffic signal control module 945 is configured to receive information pertaining to control and operation of traffic signals at the intersections along the path of a connected vehicle. The traffic signal control module 945 may receive the traffic light timing information from a traffic signal control system, such as the traffic signal control system 215 of FIG. 2.

The route optimization module 950 may be configured to determine the optimized route information for the connected vehicles based on the alternative route options and one or more route selection criteria, as discussed above.

The occupant feedback module 955 may be configured to transmit the optimized route information to the connected vehicle, and receive occupant (e.g. driver or rider) feedback from the connected vehicle. In some cases, two or a small subset of route options are transmitted to the driver or rider of the connected vehicle, and the optimized route is selected based on the occupant feedback. For example, the driver or rider may be asked to select between a route option that is the quickest but is tolled, or a route option that is slower in comparison. Based on received occupant feedback, the optimized route for the corresponding connected vehicle is selected.

As discussed above, in some cases, the driver or the rider may be triggered to subscribe to a priority level as soon as the driver or the rider gets onboard. In such cases, the selected priority level may determine the optimized route to be selected for the connected vehicle. For example, if the driver or the rider subscribed to a higher priority level, then the fastest route, albeit tolled, will be provided to the connected vehicle. The toll will be automatically charged and the driver or the rider will be accordingly informed.

Figure 10:
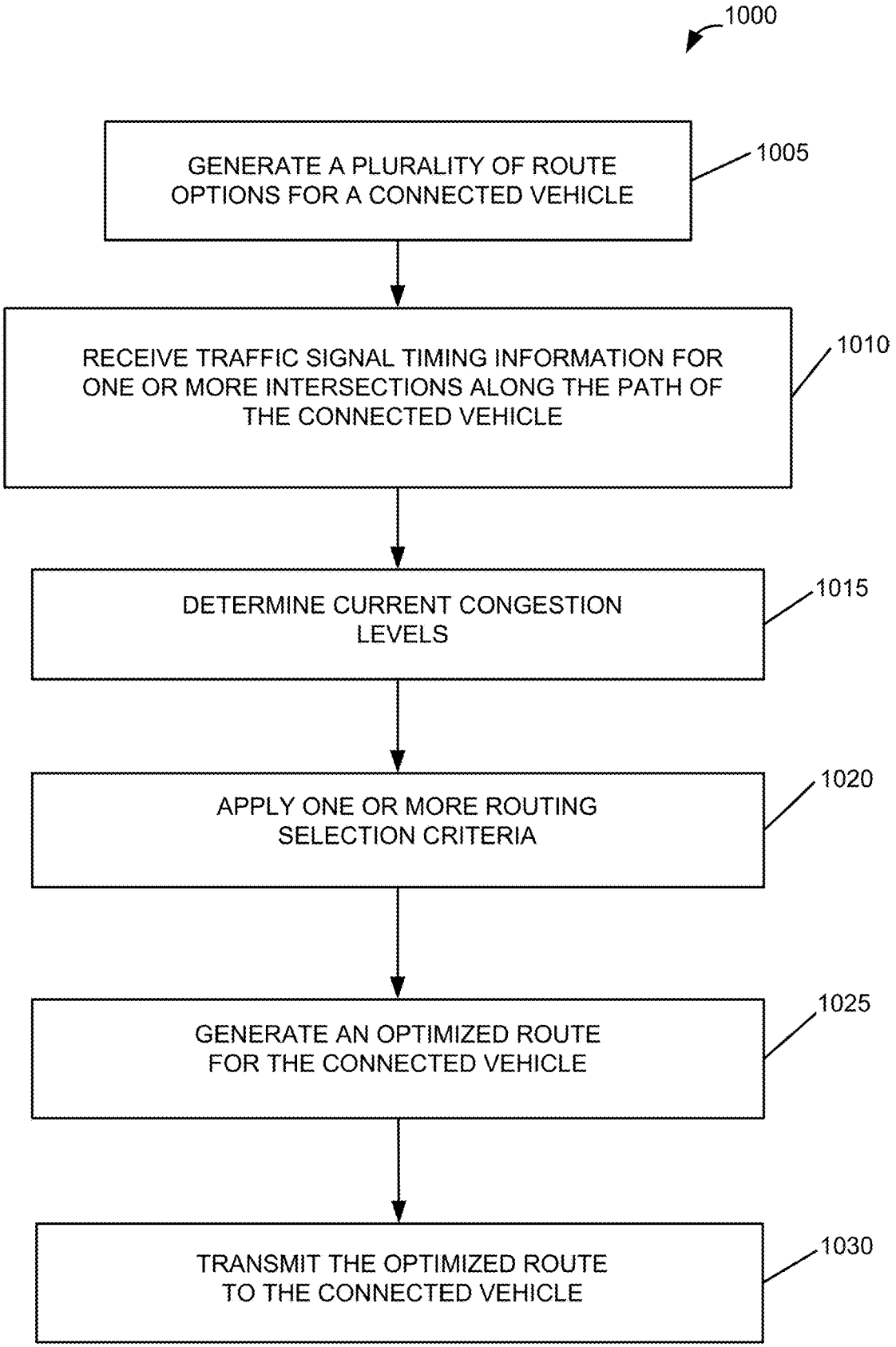
FIG. 10 shows an example of a process flow diagram for the route optimization system of FIG. 9.

Reference is next made to FIG. 10, which illustrates an example of a process flow diagram 1000 of a route optimization system, such as the route optimization system 230 of FIG. 2 according to the teachings herein.

Process 1000 begins at 1005 where a plurality of route options for a connected vehicle are generated. The plurality of route options include alternative routes between the indicated origin and destination locations of the connected vehicle. The plurality of route options may be based on the current location of the connected vehicle and the indicated destination location of the connected vehicle. Such origin, destination and/or current location of the connected vehicle may be provided by the connected vehicle itself.

At 1010, traffic signal timing information for one or more intersections along the path of the connected vehicle is received. Such information may be received from a traffic signal control system, such as the traffic signal control system 215. Traffic signal timing information may include information regarding the amount of time for which the traffic signal at each approach relevant to the connected vehicle will stay red or green or yellow, etc.

At 1015, the current congestion level at one or more intersections along the path of the connected vehicle is determined. In some cases, the current congestion level is determined for each proposed alternative route available to the connected vehicle. The current congestion level may be determined based on the estimated queue lengths for each approach relevant to the connected vehicle along its path.

At 1020, one or more routing selection criteria are applied to the plurality of alternative route. The routing selection criteria my include information such as road restrictions, toll road information and/or predetermined rules, as discussed above.

At 1025, an optimized route for the connected vehicle is generated based on the inputs at 1010, 1015 and 1020. The optimized route may be selected based on a predetermined criteria, such as the highest LoS, or lowest congestion rate, etc. The predetermined criteria may be based on the overall congestion or LoS over the road network. In some cases, the predetermined criteria may be based on the congestion or LoS along the route of the connected vehicle, which may include one or more pathways but not the entire road network.

The process ends at 1030, where the optimized route is transmitted to the connected vehicle. In an optional embodiment, feedback from the driver or rider of the connected vehicle received the optimized route may be received.

Numerous specific details are set forth herein in order to provide a thorough understanding of the exemplary embodiments described herein. However, it will be understood by those of ordinary skill in the art that these embodiments may be practiced without these specific details. In other instances, well-known methods, procedures and components have not been described in detail so as not to obscure the description of the embodiments. Furthermore, this description is not to be considered as limiting the scope of these embodiments in any way, but rather as merely describing the implementation of these various embodiments.

The invention claimed is:

1. A method of traffic management in a road network including a plurality of pathways and at least one intersection corresponding to two or more of the plurality of pathways, the method being implemented by a traffic management system including a processor and a memory coupled to the processor and configured to store instructions executable by the processor, the method comprising:

receiving, at the processor, a plurality of data signals from a corresponding one or more connected vehicles;

generating, at the processor, an intersection model for each approach of each intersection in the road network, the intersection model being generated at a first time based on the plurality of data signals, the intersection model comprising estimated arrival times for incoming vehicles at each approach at the first time;

generating, at the processor and at the first time, for each intersection, a plurality of candidate traffic timing data signals for controlling an operation of one or more traffic signals at the intersection, the plurality of candidate traffic timing data signals being generated based at least on the intersection model corresponding to all approaches at the intersection; and generating, at the processor and at the first time and after generating the plurality of candidate traffic timing data signals, for each intersection, an optimized traffic timing data signal, the optimized traffic timing data signal being configured to control the operation of one or more traffic signals at the intersection, and being generated based on the plurality of candidate traffic timing data signals and at least one predetermined optimization variable.

2. The method of claim 1, wherein the at least one predetermined optimization variable minimizes an overall arrival time corresponding to that intersection.

3. The method of claim 1, wherein the at least one predetermined optimization variable minimizes an overall travel time corresponding to the road network.

4. The method of claim 1, further comprising:

generating, at the processor and at the first time, a routing signal for a connected vehicle, the routing signal being configured to route the connected vehicle between a current location and a destination location associated with the connected vehicle, the routing signal being based at least on a predetermined routing variable, the plurality of data signals and the optimized traffic timing data signals.

5. The method of claim 4, wherein the predetermined routing variable is configured to minimize an overall travel time between the current location and the destination location of the connected vehicle.

6. The method of claim 4, wherein the predetermined routing variable is configured to minimize an overall travel time associated with the one or more connected vehicles in the road network.

7. The method of claim 4, further comprising:

receiving, at the processor, a feedback signal from a driver of the connected vehicle.

8. The method of claim 1, wherein at least some data signals comprise an originating location and a destination location of the corresponding connected vehicle.

9. The method of claim 1, further comprising:

receiving, at the processor, one or more infrastructure data signals comprising traffic information detected by one or more sensors along the road network.

10. The method of claim 9, wherein at least one traffic signal control parameter corresponds to a regulation standard.

11. The method of claim 1, wherein at least one data signal comprises a current location of an unconnected vehicle.

12. The method of claim 11, wherein the at least one data signal comprises a current speed of the unconnected vehicle.

13. The method of claim 1, further comprising:

generating, at the processor, for each intersection, a plurality of intermediate traffic timing data signals from the plurality of candidate traffic timing data signals based on one or more traffic signal control parameters.

14. The method of claim 1, wherein the first time is a predetermined range of time.

15. The method of claim 1, wherein the first time in a predetermined instance of time.

16. A traffic management system for managing traffic in a road network including a plurality of pathways and at least one intersection corresponding to two or more of the plurality of pathways, the traffic management system comprising:

a processor unit; and a memory unit coupled to the processor unit and configured to store instructions executable by the processor unit;

the processor unit being configured to:

receive a plurality of data signals from a corresponding one or more connected vehicles;

generate an intersection model for each approach of each intersection in the road network, the intersection model being generated at a first time based on the plurality of data signals, the intersection model comprising estimated arrival times for incoming vehicles at each approach at the first time;

generate at the first time, for each intersection, a plurality of candidate traffic timing data signals for controlling an operation of one or more traffic signals at the intersection, the plurality of candidate traffic timing data signals being generated based at least on the intersection model corresponding to all approaches at the intersection; and generate, at the first time and after generating the plurality of candidate traffic timing data signals, for each intersection, an optimized traffic timing data signal, the optimized traffic timing data signal being configured to control the operation of one or more traffic signals at the intersection, and being generated based on the plurality of candidate traffic timing data signals and at least one predetermined optimization variable.

17. The system of claim 16, wherein the at least one predetermined optimization variable minimizes an overall arrival time corresponding to that intersection.

18. The system of claim 16, wherein the at least one predetermined optimization variable minimizes an overall travel time corresponding to the road network.

19. The system of claim 16, wherein the processor unit is further configured to generate, at the first time, a routing signal for the connected vehicle, the routing signal being configured to route the connected vehicle between a current location and a destination location associated with the connected vehicle, the routing signal being based at least on a predetermined routing variable, the plurality of data signals and the optimized traffic timing data signals.

20. The system of claim 19, wherein the predetermined routing variable is configured to minimize an overall travel time between the current location and the destination location of the connected vehicle.

21. The system of claim 19, wherein the predetermined routing variable is configured to minimize an overall travel time associated with the one or more connected vehicles in the road network.

22. The system of claim 16, wherein at least some data signals comprise an originating location and a destination location of the corresponding connected vehicle.

23. The system of claim 16, wherein the processor unit is further configured to receive one or more infrastructure data signals comprising traffic information detected by one or more sensors along the road network.

24. The system of claim 16, wherein at least one data signal comprises a current location of an unconnected vehicle.

25. The system of claim 16, wherein the processor unit is further configured to generate, for each intersection, a plurality of intermediate traffic timing data signals from the plurality of candidate traffic timing data signals based on one or more traffic signal control parameters.

26. The system of claim 25, wherein at least one traffic signal control parameter corresponds to a regulation standard.

27. The system of claim 16, wherein the first time is a predetermined range of time.

28. The system of claim 16, wherein the first time in a predetermined instance of time.

29. A non-transitory computer-readable medium storing computer-executable instructions, the instructions for causing a processor to perform a method of managing traffic over a road network, the method comprising:

receiving, at the processor, a plurality of data signals from a corresponding one or more connected vehicles;

generating, at the processor, an intersection model for each approach of each intersection in the road network, the intersection model being generated at a first time based on the plurality of data signals, the intersection model comprising estimated arrival times for incoming vehicles at each approach at the first time;

generating, at the processor and at the first time, for each intersection, a plurality of candidate traffic timing data signals for controlling an operation of one or more traffic signals at the intersection, the plurality of candidate traffic timing data signals being generated based at least on the intersection model corresponding to all approaches at the intersection; and generating, at the processor and at the first time and after generating the plurality of candidate traffic timing data signals, for each intersection, an optimized traffic timing data signal, the optimized traffic timing data signal being configured to control the operation of one or more traffic signals at the intersection, and being generated based on the plurality of candidate traffic timing data signals and at least one predetermined optimization variable.

* * * * *